US008360946B2

(12) United States Patent
Giro Amigo

(10) Patent No.: US 8,360,946 B2
(45) Date of Patent: Jan. 29, 2013

(54) MACHINE FOR THE MANUFACTURE OF BAGS

(75) Inventor: Ezequiel Giro Amigo, Badalona (ES)

(73) Assignee: Girnet Internacional, S.L., Badalona (ES)

( * ) Notice: Subject to any disclaimer, the term of this patent is extended or adjusted under 35 U.S.C. 154(b) by 368 days.

(21) Appl. No.: 12/693,138

(22) Filed: Jan. 25, 2010

(65) Prior Publication Data

US 2010/0197474 A1 Aug. 5, 2010

(30) Foreign Application Priority Data

Feb. 3, 2009 (ES) ..... 200900220 U

(51) Int. Cl.
*B31B 1/00* (2006.01)
*B31B 49/04* (2006.01)
*H01Q 13/10* (2006.01)

(52) U.S. Cl. ..... 493/8; 53/64; 53/168; 493/186; 343/767

(58) Field of Classification Search ..... 493/2, 27, 493/8, 17, 24, 186; 343/767, 769; 340/572, 340/10.1; 253/375; 53/64, 168; *B31B 1/00, B31B 49/04*

See application file for complete search history.

(56) References Cited

U.S. PATENT DOCUMENTS 5,376,943 A * 12/1994 Blunden et al. ..... 343/795
5,537,798 A * 7/1996 Fukuda et al. ..... 53/168
5,892,487 A * 4/1999 Fujimoto et al. ..... 343/840
6,138,439 A * 10/2000 McMahon et al. ..... 53/412
6,209,287 B1 * 4/2001 Thieman ..... 53/412
6,644,544 B1 * 11/2003 Spurr et al. ..... 235/375
7,063,470 B2 * 6/2006 Spurr et al. ..... 400/207
7,564,356 B1 * 7/2009 Youn ..... 340/572.1
2001/0049924 A1 * 12/2001 Dauder Guardiola ..... 53/567
2005/0198920 A1 * 9/2005 Nakagawa et al. ..... 53/64
2006/0162284 A1 * 7/2006 Nakagawa et al. ..... 53/168
2007/0011990 A1 * 1/2007 Ebert ..... 53/417
2007/0180793 A1 * 8/2007 Meyrahn et al. ..... 53/138.3
2007/0251190 A1 * 11/2007 Daigle et al. ..... 53/403
2008/0307754 A1 * 12/2008 Storig et al. ..... 53/64
2009/0051598 A1 * 2/2009 McCarrick et al. .... 343/700 MS

FOREIGN PATENT DOCUMENTS

EP 549806 A1 * 7/1993
EP 1 266 830 A1 12/2002
EP 1266830 A1 * 12/2002
EP 1 988 027 A1 11/2008
JP 2005230242 A * 9/2005
JP 2007253979 A * 10/2007

* cited by examiner

*Primary Examiner* — Stephen F Gerrity
(74) *Attorney, Agent, or Firm* — Sughrue Mion, PLLC

(57) ABSTRACT

A machine (1) for the manufacture of bags, having a support element (2, 3, 4) for detachably coupling a corresponding portable storage (22, 33, 44) of a consumable material (22*a*, 33*a*, 44*a*) from which the bags are made and mechanical mechanism for making bags from the material. A remote reading mechanism (5) is provided for reading the information stored in a radiofrequency tag (6, 7, 8) included in the portable storage, as well as a control unit (18) which contains a mechanism for obtaining information from the radiofrequency tag, which allows identifying the type of consumable material coupled in the support element, and for automatically generating a signal for controlling the mechanical mechanism.

8 Claims, 4 Drawing Sheets

MACHINE FOR THE MANUFACTURE OF BAGS

TECHNICAL FIELD OF THE INVENTION

The invention relates to a machine for the manufacture of bags of the type comprising one or more support elements suitable for the detachable coupling of respective winding cores of consumable materials from which the bags are made, such as a film or a tubular mesh, and mechanical means for making bags from the mentioned consumable materials.

BACKGROUND OF THE INVENTION

There are different variants of automatic machines for the manufacture, filling and closing of bags, such as mesh bags which house fruit and vegetable products, in which the bags are made from consumable materials such as a continuous tubular mesh and continuous bands of plastic material, gathered in respective portable storages coupled to the machines and from which the material is drawn as the bags are made.

These portable storages are commonly formed by reels, in which the consumable material is wound around a winding core, being able to also adopt other forms in the case of storing gathered continuous tubular mesh compacted in the longitudinal direction.

This type of machine generally comprises a series of support elements in the form of rotating shafts, in which the respective winding cores of the different consumable materials necessary for the manufacture of the bags are coupled, or in the form of a tubular body, on which the storage of tubular mesh longitudinally compacted such that the mesh encompasses the mentioned tubular body is assembled. By way of example and for the manufacture of mesh bags machines comprising a rotating shaft for the firm coupling of a reel which stores the continuous tubular mesh and two rotating shafts for the firm coupling of respective reels of bands of heat-weldable material can be used. For another type of bag in which at least one band of plastic material is used for making a handle, such as that described in patent document EP1988027, machines comprising a tubular body on which a storage of gathered tubular mesh compacted in the longitudinal direction is placed outside, and inside of which the product is introduced in the bag in the course of manufacture, and at least one rotating shaft for the coupling of a reel of a band of heat-weldable material from which the handle of the bags will be formed, are used.

These machines comprise the mechanical means necessary to draw the consumable material required for the manufacture of successive bags from the portable storages and to handle these consumable materials for making them. Conventionally, in the first type of machine described the rotating shafts are motor-driven to facilitate the unwinding of the reels, such that the rotation movement of the shafts is transmitted to the winding core of the reels which rotates together with the corresponding rotating shaft.

It is also known to provide the machines with control units by means of which certain actuation parameters of the mechanical means can be adjusted, such that with one and the same machine bags having different sizes can be manufactured, for example. Furthermore, it is frequent that one and the same machine is used for the manufacture of different types of bags, which require the compliance with different specifications in connection to the material or to the finish, being to that end necessary to replace the reels of consumable material coupled to the rotating shafts with other reels according to the new type of bag. The operation for changing the consumable materials is carried out following a strict control protocol, for the purpose of preventing serious errors which can alter the operation of the machine or lead to the manufacture of erroneous batches of bags.

The first case can take place when the consumable material wound in the reel installed in the machine cannot be handled in accordance with the program for actuating the mechanical means. This situation can occur for example when the heat supplied by the welding means which intervene in the step of closing of the bags is not suitable for the material forming the bands of heat-weldable material. By way of example, the second case can take place when bags obtained from bands printed with different motifs or of different width, or from a mesh having a configuration different from what is desired or demanded by the recipient of the bags, are manufactured.

The main objective of the present invention is to disclose a machine capable of identifying the consumable materials of the portable storages which are coupled to the respective support elements of the machines, for the purpose of assuring that said materials are the suitable ones, in each manufacturing batch, for the production of a predetermined type of bag.

The objective of the present invention is also that the means provided for such effect can be easily installed in pre-existing machines, without being necessary to redesign or replace a significant number of components of the machines, and therefore that their installation is not too expensive or complicated.

Patent document EP 1266830 discloses a system for identifying in a machine for the manufacture of packaging material a consumable material which is supplied in the form of a band, the system including means for radiofrequency communication between said material in the form of a band and the machine. Said communication means comprise an antenna suitable for the remote reading of the data stored in a transponder housed in the winding core of the consumable material.

The described system has no direct application for the first type of machine to which reference is made in the present invention, since only information of a single consumable material the winding core of which is in addition coupled to a rotating shaft preferably of a plastic material is obtained.

Apart from the fact that the rotating shafts of the pre-existing machines are conventionally metallic, which causes interferences in the radiofrequency communication, the fact that the machines are provided with a plurality of rotating shafts for the coupling of different windings of consumable material necessary to make one and the same bag, together with the fact that said rotating shafts are arranged not too far from one another, involves an added difficulty if individual information is to be obtained from each of said materials without the proximity of the different cores generating interferences in the radiofrequency communication, all this without giving up a broad enough reading field to detect radiofrequency tags applied on the winding core when the latter adopts different angle positions during its rotation.

Furthermore, in the event that the mentioned rotating shafts are motor-driven, a variant that is not reflected in the system described in document EP 1266830, the proximity of the drive motor, the metallic nature of its components and even the attraction magnetic field of the rotor also affect the reading field of the corresponding antenna, which up until now has discouraged the person skilled in the art to contemplate the solution described in EP1266830 as a solution applicable to the specific sector of the invention. However, if the mentioned drawbacks are removed, the radiofrequency communication is very suitable for solving the problem considered.

A secondary objective of the present invention therefore is to provide the machine with radiofrequency communication means which overcome the aforementioned drawbacks.

DISCLOSURE OF THE INVENTION

The machine for the manufacture of bags object of the invention comprises as is known at least one support element suitable for the detachable coupling of a corresponding portable storage of a consumable material from which the bags are made, such as a film or a tubular mesh, and mechanical means for making bags from the mentioned consumable material.

In essence, the machine is characterized in that it is provided with remote reading means for reading the information stored in a radiofrequency tag included in the mentioned portable storage when the latter is conveniently coupled in the support element; and with a control unit connected to the reading means which contains means for obtaining information from the radiofrequency tag, which allows identifying the type of consumable material coupled in the mentioned support element, and for automatically generating a signal for controlling the mechanical means, susceptible of being used to stop the operation of the machine, depending on the information obtained by said control unit.

In an embodiment variant, the machine comprises several support elements, intended to receive the coupling of respective portable storages of consumable material which include respective radiofrequency tags, the remote reading means comprising a plurality of transmitting and receiving antennas each of which is assembled in the vicinity of an associated support element and is suitable for the reading of only the radiofrequency tag or tags included in the portable storage coupled to the associated support element thereof, all the antennas being connected to the control unit, which contains or is connected to programmable means suitable for checking if the combination of the consumable materials identified matches one of the combinations stored in a database.

According to another feature, at least one of the support elements is formed by a rotating shaft suitable for the coupling of a winding core of a portable storage of consumable material in the form of a roll, and the associated antenna is arranged in the proximal end of said rotating shaft, fixed relative to the chassis of the machine and inscribed in a plane perpendicular to the rotating shaft.

According to another feature of the invention, the antenna is formed by a feed microstrip strip and an exceeded arch-shaped slot located in a ground plane parallel to the microstrip line and separated from the latter by a dielectric substrate.

The length of the slot is preferably such that when the antenna transmits and receives in a frequency within the radiofrequency tag working bandwidth, the antenna radiates essentially in its second resonance mode.

According to another feature of the invention, the antenna working frequency is 800 to 900 MHz.

BRIEF DESCRIPTION OF THE DRAWINGS

An embodiment of a machine according to the invention is illustrated by way of non-limiting example in the attached drawings. In said drawings.

DETAILED DESCRIPTION OF THE DRAWINGS

Figure 1:
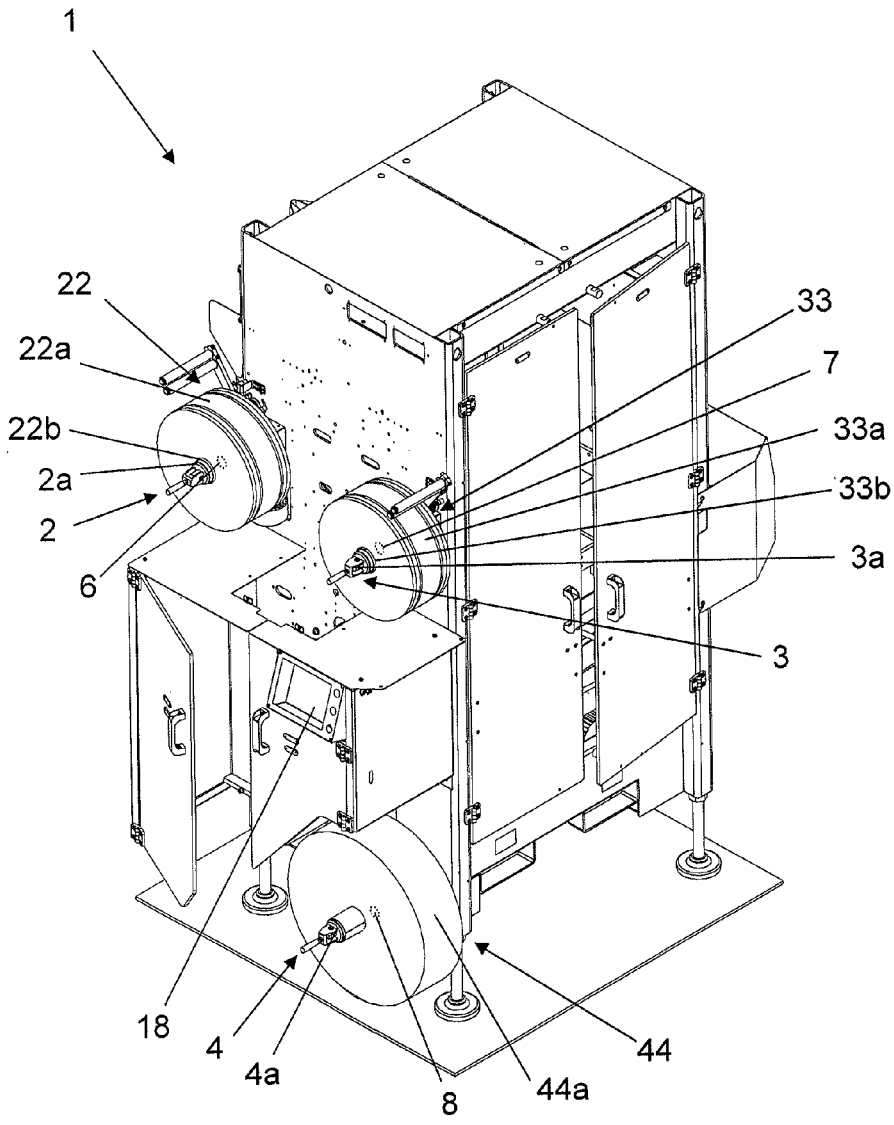
FIG. 1 is a perspective view of a machine provided with three rotating shafts in which respective storage reels of three consumable materials from which the bags are made are coupled.

The machine 1 depicted in FIG. 1 is a known automatic machine for the manufacture of mesh bags. This machine 1 is provided with three support elements 2, 3 and 4 comprising respective rotating shafts 2*a*, 3*a* and 4*a* in each of which a corresponding portable storage 22, 33 and 44, in the form of a reel, of a consumable material is coupled. In the machine 1 depicted, the consumable materials 22*a*, 33*a* and 44*a* are formed by respective bands of heat-weldable material and a continuous tubular mesh, respectively.

The machine 1 is furthermore provided with the mechanical means for making bags from said consumable materials 22*a*, 33*a* and 44*a*, such as grips, drawing, cutting and welding, transporting devices, etc., which are not described in detail due to being known.

For the purpose of automatically identifying the consumable materials 22*a*, 33*a* and 44*a* wound in the portable storages 22, 33 and 44, respectively, in the form of reels, the machine 1 is provided with remote reading means 5 (see FIG. 2) for reading the information stored in radiofrequency tags 6, 7 and 8 included in each of said portable storages 22, 33 and 44, preferably applied on the winding core of said reels, as well as with a control unit 18 (see FIG. 3), connected to the remote reading means 5, which contains means for obtaining information from said radiofrequency tags 6, 7 and 8 by means of which it is possible to identify the type of consumable material wound in the reels coupled in each of the rotating shafts 2*a*, 3*a* and 4*a*. The control unit 18 furthermore contains means for automatically generate a signal for controlling the mechanical means depending on the information obtained from the radiofrequency tags 6, 7 and 8 by said control unit 18.

Figure 2:
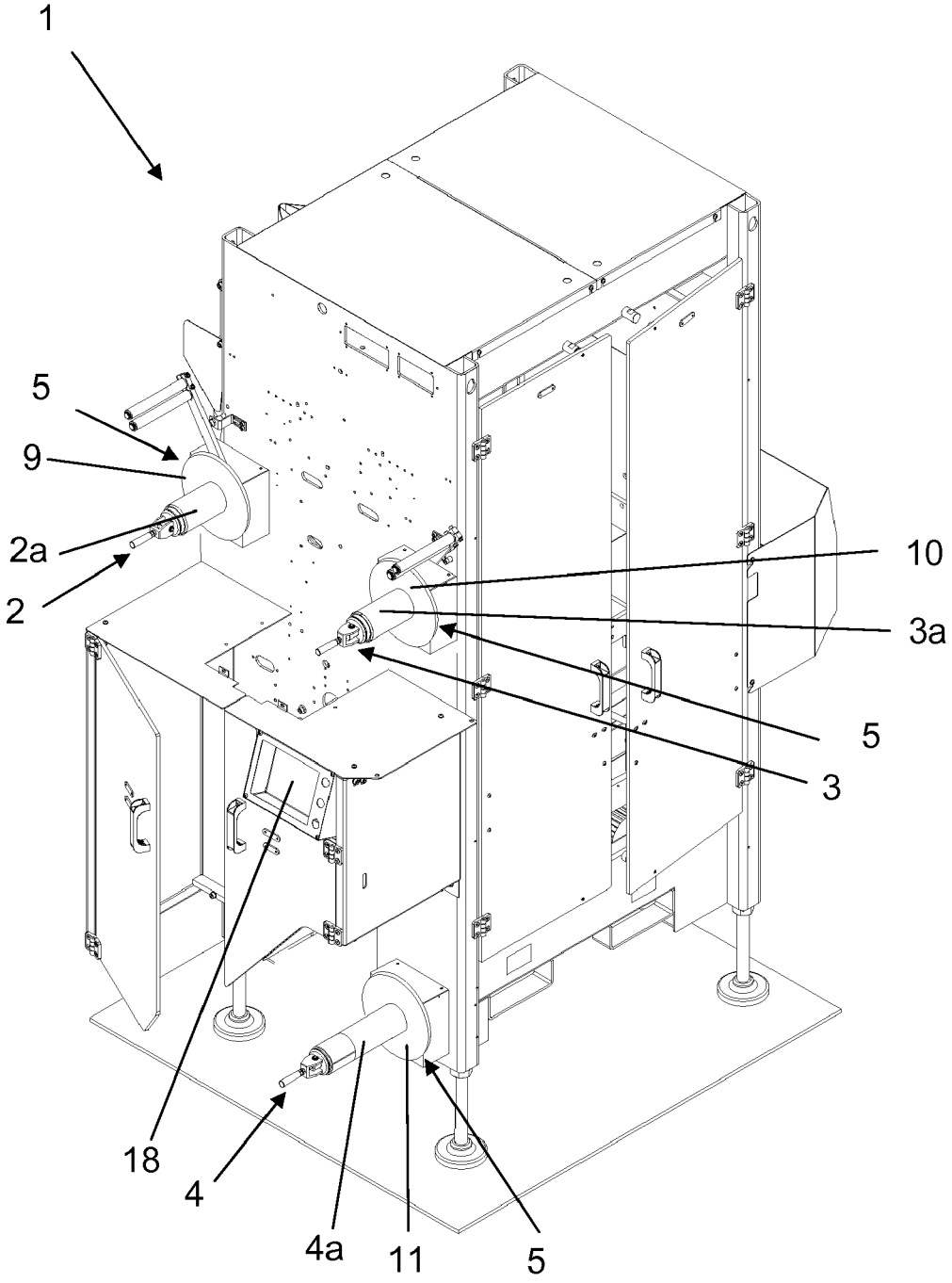
FIG. 2 is a perspective view of the machine of FIG. 1, without the storage reels of the consumable materials.

For this purpose, as can be observed in FIG. 2, the remote reading means 5 comprise three transmitting and receiving antennas 9, 10 and 11, each of which is assembled in the proximal end of a rotating shaft 2*a*, 3*a* and 4*a* to establish a one-way and reciprocal communication with the radiofrequency tag or tags included in the portable storage 22, 33 or 44 coupled to said rotating shaft.

The information read by the antennas 9, 10 and 11 is transmitted to the control unit 18, in which from said information, data relative, among others, to the origin of the consumable material, to its manufacture date and especially to the type of consumable material involved are obtained. This obtained information is used to generate actuation signals or to automatically preselect adjustment parameters, for example of the grips, the drawing, cutting and welding or transporting devices. One of the noteworthy uses among those that are possible is that in which the control unit 18 contains or is connected to programmable means suitable for checking if the combination of the consumable materials identified matches one of the combinations stored in a database, and for generating a signal suitable for stopping the operation of the machine 1 in the event that the match is not positive.

Figure 3:
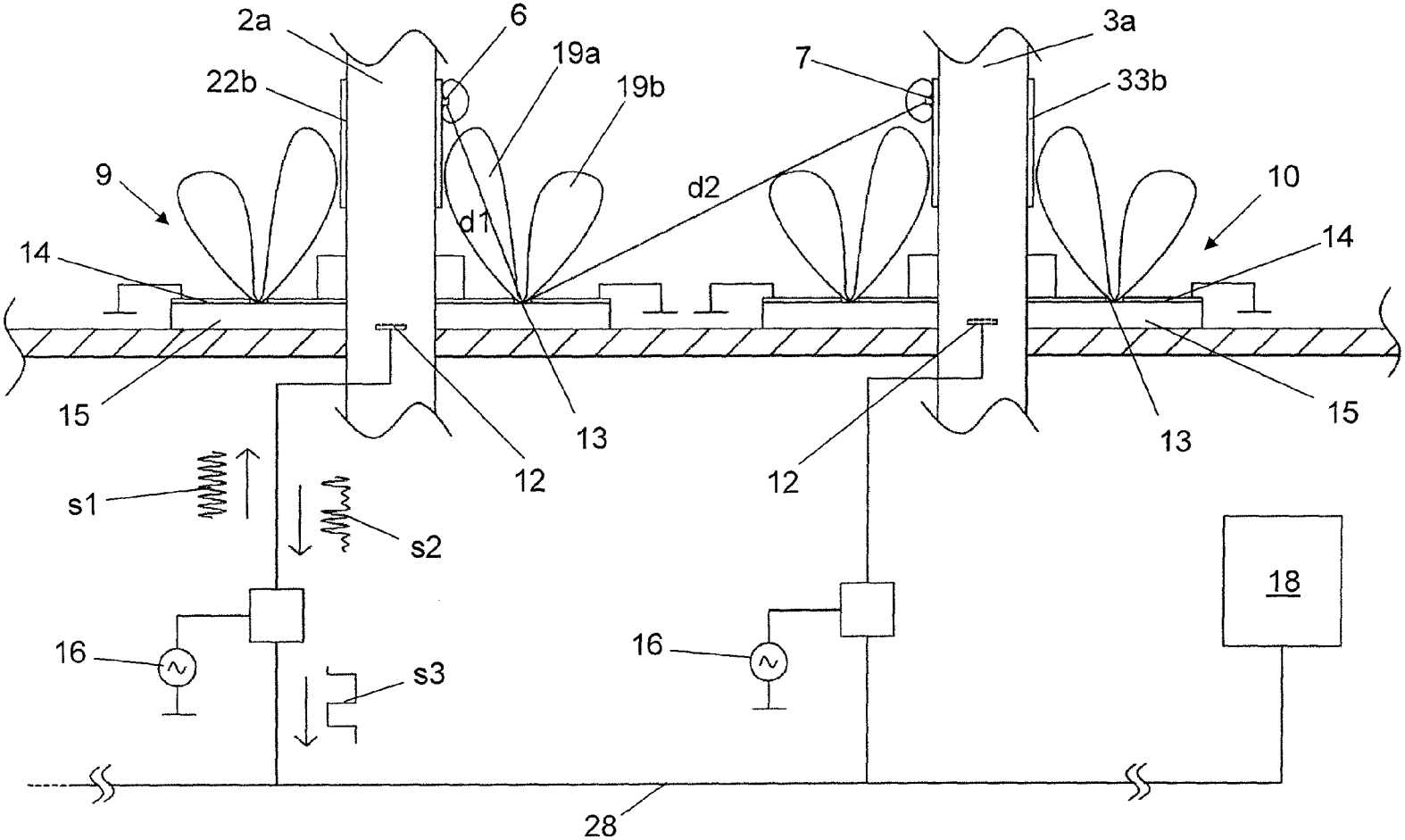
FIG. 3 is a scheme for the installation of the remote reading means of a machine according to the invention, provided with rotating shafts arranged adjacent.

It can be seen in FIG. 2, and in greater detail in FIG. 3, that the antennas 9, 10 and 11 are arranged in the proximal end of the rotating shafts 2*a*, 3*a* and 4*a*, respectively, fixed relative to the chassis of the machine 1 and inscribed in a plane perpendicular to the mentioned rotating shafts 2*a*, 3*a* and 4*a*.

FIG. 3 illustrates a scheme for the operation of the antennas 9 and 10, in the rotating shafts 2*a* and 3*a* of which the winding cores 22*b* and 33*b* are coupled, respectively, in which respective radiofrequency tags 6 and 7 are applied. Given the proximity between the rotating shafts 2*a* and 3*a*, it is necessary to configure the antenna 9 such that it is capable of receiving the signal emitted by the radiofrequency tag 6, the radiation diagram of which is essentially omnidirectional, but not of receiving the signal emitted by the radiofrequency tag 7, to avoid confusion with respect to the consumable material installed in the rotating shaft 2*a*.

For this purpose, the power of feed signal s1, generated by the signal generator 16 and delivered by the antenna 9 in a first direction d1, has to be sufficient so that, taking into account the attenuation due to the propagation of the feed signal, the power received by the radiofrequency tag 6 is suitable so that the latter can transmit the information stored until reaching the antenna 9. This same power of feed signal s1, however, has to be suitable so that the information stored in the radiofrequency tag 7 is not received upon radiating in a second direction d2. For the purpose of achieving the aforementioned purpose, the antenna 9 has been designed so that, at the working frequency of the radiofrequency tag 6, it radiates according to its second resonant mode, such that a first power lobe 19*a* is achieved, the radiated power of which in the first direction d1 is suitable for the correct operation of the transmission of information from the radiofrequency tag 6, and a second power lobe 19*b*, which does not radiate sufficiently in the direction d2 so that the antenna 9 receives the information stored in the radiofrequency tag 7.

The modulated signal s2 received by the antenna 9 and coming from the radiofrequency tag 6 is transmitted from the antenna 9, by means of transmission lines of those known in the state of the art, to demodulation and adaptation means for extracting the binary information contained in the modulated signal s2 and injecting said information by means of a binary signal s3 into the data bus 28 of the control unit 18.

Figure 4:
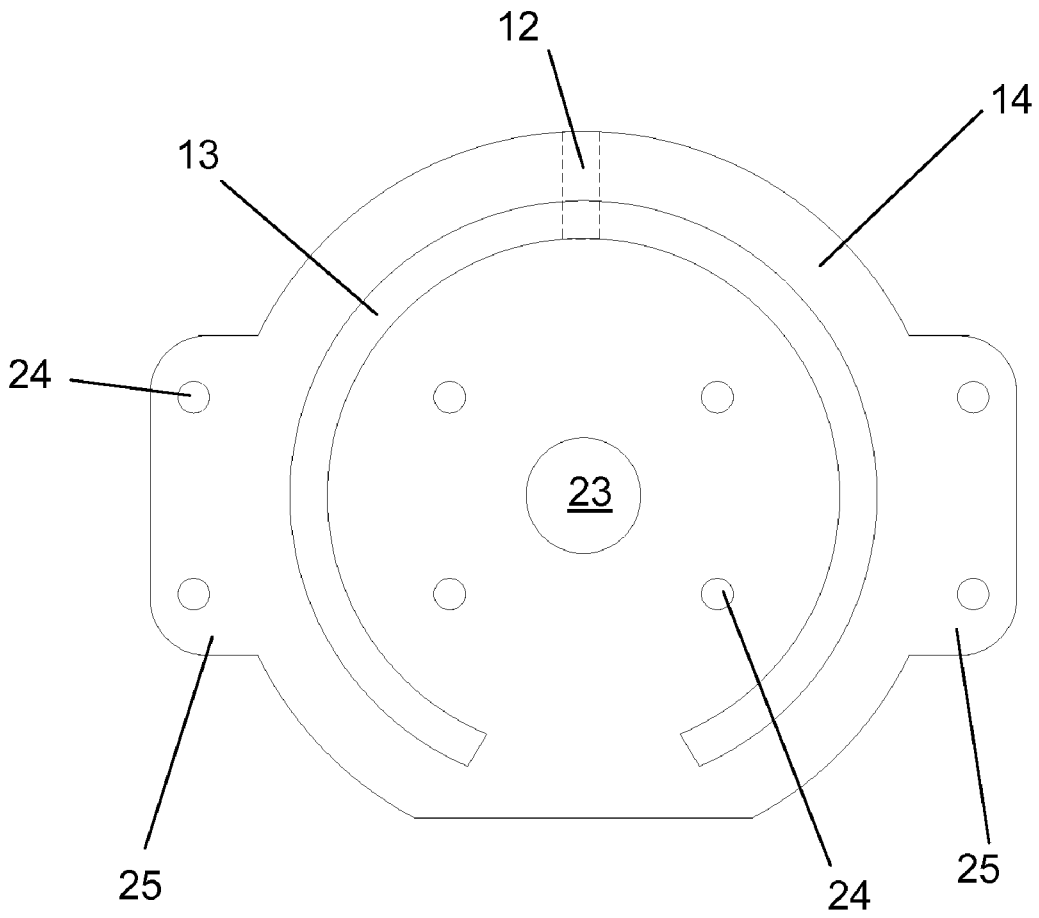
FIG. 4 is a plan view of an antenna of the remote reading means.

The antennas 9, 10 and 11 of the machine 1 are slot antennas as shown in FIG. 4, the slot 13 of which is located in a ground plane 14, curved like an exceeded arch with a radius essentially constant around a central through hole 23 through which the rotating shaft will pass when it is assembled in the machine 1, as can be observed in FIGS. 2 and 3, and which is separated from a microstrip strip 12, carrying a signal, by means of a dielectric substrate 15 (illustrated in FIG. 3) of those normally used for this type of antenna, such as alumina or RF4. The antennas 9, 10 and 11 of the machine 1 furthermore have side wings 25 provided with through holes 24 for their securing to the machine 1 by means of screws or the like.

The radiofrequency tags used in the machine 1 have a working frequency of 868 MHz, therefore, in order for the antennas 9, 10 and 11 to radiate in their first resonant mode, the length of the slot 13 would have to be too small to cover the entire perimeter of the rotating shaft, thereby readings could not be done when the radiofrequency tag adopts certain angular positions. To avoid this drawback, the antenna is configured so that it radiates in its second resonant mode, the length of the slot 13 being able to be folded in this case and thus cover most of the reading angles.

Naturally, other metallic components of the machine 1, as well as motors or other interference generators, will mean that the antennas 9, 10 and 11 never behave in the ideal way described in the present document once installed in the machine 1, therefore, as is already known by the persons skilled in the art, a final process for the adjustment to the actual environment will be necessary, experimentally or by means of simulation, both of the dimensions and of the power radiated by each of the antennas 9, 10 and 11, so that the latter behave in a way closer to the ideal.

The invention claimed is:

1. A machine for the manufacture of bags, comprising at least one support element formed by a rotating shaft suitable for the detachable coupling of a winding core of a portable storage of a consumable material in the form of a roll from which the bags are made and mechanical means comprising a transmitting and receiving antenna arranged to transmit and receive at a working frequency for making bags from the consumable material, the machine provided with remote reading means for reading information stored in a radiofrequency tag included in the portable storage when the portable storage is coupled in the at least one support element; and with a control unit connected to the reading means which contains means for obtaining information from the radiofrequency tag, which allows identifying the type of consumable material coupled in the at least one support element, and for automatically generating a signal for controlling the mechanical means, susceptible of being used to stop the operation of the machine, depending on the information obtained by said control unit; the antenna arranged in the proximal end of the rotating shaft, fixed relative to the chassis of the machine and extending in a plane perpendicular to the rotating shaft; the antenna comprising a feed microstrip and a curved exceeded arch-shaped radiant slot located in a ground plane parallel to the microstrip and separated from the microstrip by a dielectric substrate, the curve of the slot having a substantially constant radius and curved around a central hole through which the shaft passes.

2. The machine according to claim 1, comprising several support elements, configured to receive the coupling of respective portable storages of consumable material which include respective radiofrequency tags, the remote reading means comprising a plurality of transmitting and receiving antennas each of which is assembled in the vicinity of an associated support element and is suitable for the reading of only the radiofrequency tag or tags included in the portable storage coupled to an associated one of the support elements, all the antennas being connected to the control unit, which contains or is connected to programmable means suitable for checking if the combination of the consumable materials identified matches a combination stored in a database.

3. The machine according to claim 1, wherein a length of the slot is such that when the antenna transmits and receives at the working frequency within the working bandwidth of the radiofrequency tag, the antenna essentially radiates in its second resonance mode.

4. The machine according to claim 1, wherein the working frequency of the antenna is 800 to 900 MHz.

5. The machine according to claim 1, wherein the consumable material comprises a band of tubular mesh.

6. The machine according to claim 1, wherein the slot is a closed slot.

7. The machine according to claim 1, wherein a length of the slot is between 33.3 cm and 37.5 cm.

8. A machine for the manufacture of bags, comprising:

a reel of material for making the bags and comprising a radiofrequency tag;

a rotating shaft on which the reel is detachably coupled;

a transmitting and receiving antenna arranged to transmit and receive at a working frequency;

a mechanism for making bags from the material;

a remote reader that reads information stored in the radiofrequency tag when the reel is coupled to the support element; and a control unit connected to the reader and configured to obtain information from the radiofrequency tag, which allows identification by the control unit of the type of material on the reel, the control unit configure to generate a signal for controlling the mechanism based at least in part on the identification of the material;

the antenna is arranged at or near a proximal end of the rotating shaft and in a plane perpendicular to the rotating shaft; the antenna comprising a feed microstrip and a curved arch-shaped radiant slot exceeding 180 degrees located in a ground plane parallel to the microstrip and separated from the microstrip by a dielectric substrate, the curve of the slot having a substantially constant radius and centered around a central hole through which the shaft passes.

* * * * *